United States Patent [19]

Hirabayashi

[11] Patent Number: 4,658,581

[45] Date of Patent: Apr. 21, 1987

[54] EXHAUST TUBE FOR VEHICLE

[75] Inventor: Hirokazu Hirabayashi, Ebina, Japan

[73] Assignee: Nissan Motor Co., Ltd., Yokohama, Japan

[21] Appl. No.: 861,009

[22] Filed: May 8, 1986

[30] Foreign Application Priority Data

May 16, 1985 [JP] Japan ..... 60-73262[U]

[51] Int. Cl.[4] ..... F01N 7/00

[52] U.S. Cl. ..... 60/322; 180/309

[58] Field of Search ..... 60/272, 322; 180/309

[56] References Cited

U.S. PATENT DOCUMENTS

| | | | |
|---|---|---|---|
| 4,114,715 | 9/1978 | Theron | 180/309 |
| 4,408,451 | 10/1983 | Sigwald | 60/322 |
| 4,596,304 | 6/1986 | Teshima | 180/309 |

*Primary Examiner*—Douglas Hart

*Attorney, Agent, or Firm*—Schwartz, Jeffery, Schwaab, Mack, Blumenthal & Evans

[57] ABSTRACT

An automobile has an exhaust tube with a muffler at the tail end thereof, which exhaust tube has a bent portion having portions of an oblong shape in cross section.

3 Claims, 6 Drawing Figures

(a)

(b)

EXHAUST TUBE FOR VEHICLE

BACKGROUND OF THE INVENTION (1) Field of the Invention

This invention relates to an exhaust tube for a vehicle for reducing vibration during idling time.

(2) Explanation of Related Art

As for a conventional exhaust tube for automobile, there is, for example, such one as shown in Nissan Service Weekly No. 428, issued Sept., 1980, Nissan Automobile Co., in which an exhaust tube provided for automobile has a bent portion of substantially L-shape at the mid portion and also a main muffler provided at the tail portion of the exhaust tube. In this kind of exhaust tube, at the region of the secondary frequencies of the revolving engine (around 20 to 30 Hz) during idling time, the exhaust tube acts like a spring and produces forward and backward resonance with the main muffler acting as a mass. This forward and backward resonance, especially in the case of FF vehicle with laterally disposed engine, causes large effect upon the vibration in the rolling direction of the engine, and deteriorates the vertical vibration of the steering wheels as well as the floor vibration. In order to prevent the deterioration of these vibrations, it is necessary to set the frequencies of the forward and backward resonance of the exhaust tube outside the region of the secondary frequencies of the revolving engine. When attempt is made to set the frequencies of this forward and backward resonance at a region of higher frequencies than the region of the secondary frequencies of the revolving engine, it is necessary to increase the rigidity of the exhaust tube.

In order to increase the rigidity of the exhaust tube, it is necessary to change the layout at the vehicle. Therefore, it becomes difficult to adopt this method. On the other hand, when attempt is made to set the frequencies of the forward and backward resonance at a region of lower frequencies than the region of the secondary frequencies of the revolving engine, it is only necessary to largely decrease the rigidity of the exhaust tube in the axial direction as well as the bent direction. For this purpose, there is adopted a method to replace a portion of the exhaust tube with a flexible tube.

However, in this kind of exhaust tube for vehicle, since the flexible tube is used for a portion of the exhaust tube, it becomes costly to manufacture, and also, since the diameter of the flexible tube is larger than the other exhaust tubes, there is a problem that the layout limitations increases.

SUMMARY OF THE INVENTION

The objects of this invention are to solve the above mentioned problems.

One major object of the present invention is to provide an exhaust tube for a vehicle with resonance decreased.

Another object of the present invention is to provide an exhaust tube with improved vertical vibration of the steering wheels as well as improved floor vibration.

Another object of the present invention is to eliminate a flexible tube from the exhaust tube.

In the exhaust tube for a vehicle in the present invention, a bent portion has portions that extend in the longitudinal and lateral directions of the vehicle and have a cross section which is approximately of an oblong-shape with its major axis lying along the vertical direction of the vehicle.

DETAILED EXPLANATION OF THE EMBODIMENT

Figure 1:
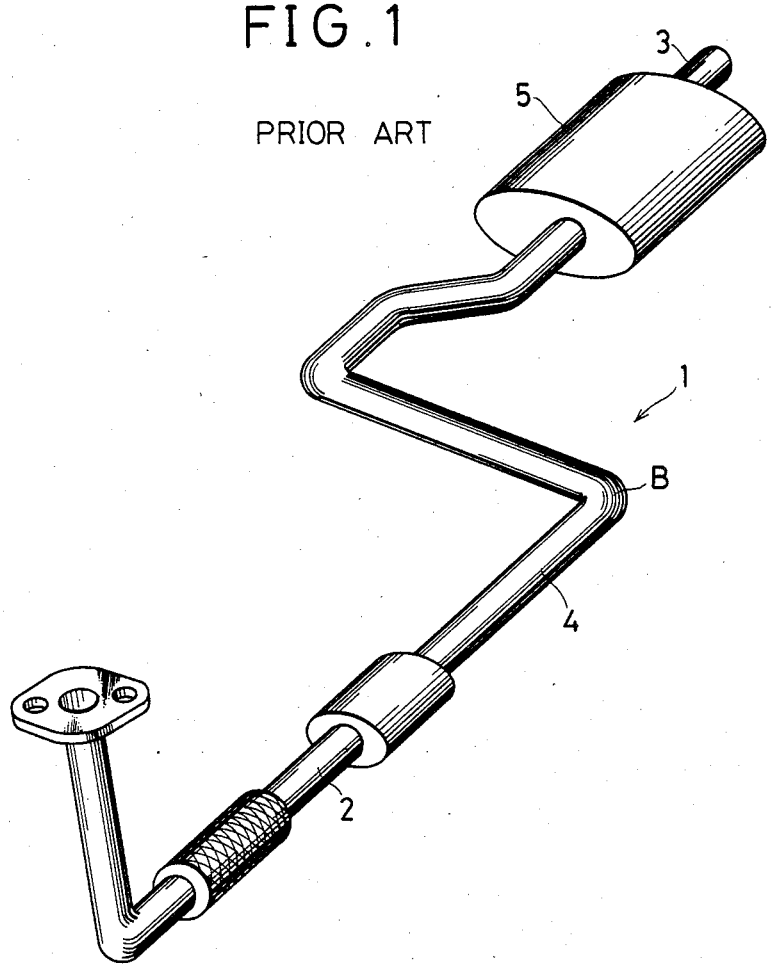
FIG. 1 PRIOR ART
FIG. 1 shows a perspective view of a conventional exhaust tube.
Figure 2:
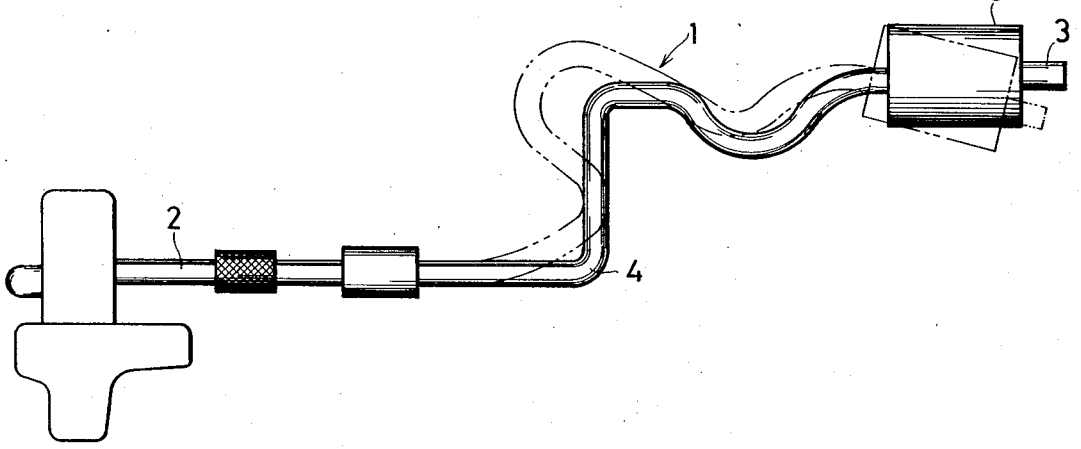
FIG. 2 PRIOR ART
FIG. 2 shows the state in which this exhaust tube of FIG. 1 is producing a forward and backward resonance.

As shown in FIG. 1 and FIG. 2, a conventional exhaust tube 1 for automobile has a center tube 4 which forms a bent portion B that is bent approximately perpendicularly from a front tube 2 towards a tail tube 3 in the lateral direction of the vehicle. Also a main muffler 5 is interposed between the center tube 4 and the tail tube 3. In this kind of exhaust tube 1, at the region of the secondary frequencies of the revolving engine (around 20 to 30 Hz) during idling time, the exhaust tube 1 acts like a spring and produces forward and backward resonance with the main muffler acting as a mass as shown in FIG. 2. This forward and backward resonance, especially in the case of FF vehicle with laterally disposed engine, causes large effect upon the vibration in the rolling direction of the engine, and deteriorates the vertical vibration of the steering wheels as well as the floor vibration. In order to prevent the deterioration of these vibrations, it is necessary to set the frequencies of the forward and backward resonance of the exhaust tube 1 outside the region of the secondary frequencies of the revolving engine. When attempt is made to set the frequencies of this forward and backward resonance at a region of higher frequencies than the region of the secondary frequencies of the revolving engine, it is necessary to increase the rigidity of the exhaust tube 1, which will cause many problems as mentioned previously.

Figure 3:
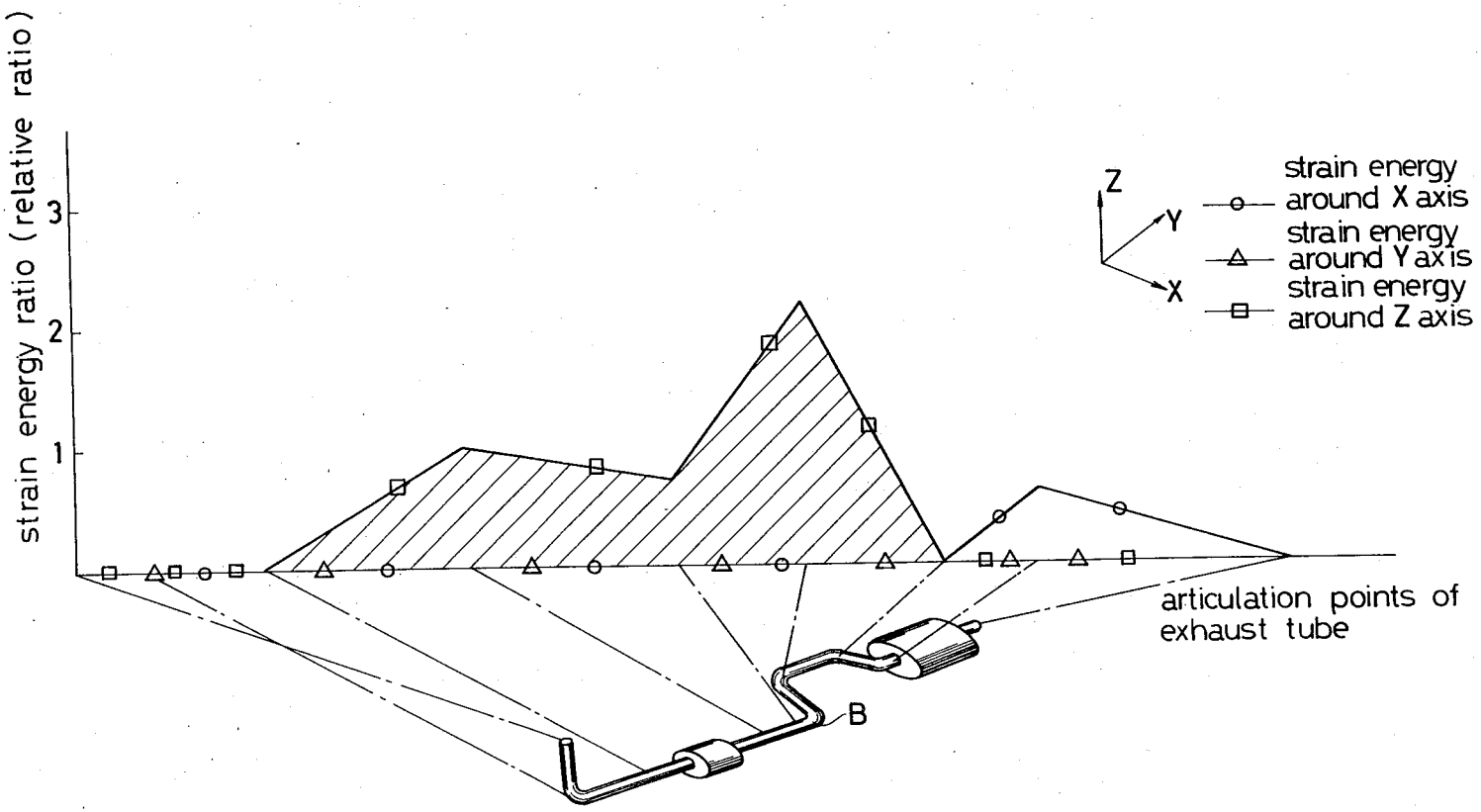
FIG. 3 is a graph which shows the distribution of the strain energy at the time of forward and backward resonance of a conventional exhaust tube in order to find out what portions of the exhaust tube should be deformed, FIG. 4 (*a*) is a perspective view showing one embodiment of the exhaust tube according to the present invention.

Now, an analytical calculation on the construction was made on an exhaust tube made of a conventional center tube which is not deformed, and being bent several times. As a result, the distribution of the strain energy during forward and backward resonance of the exhaust tube is as shown in FIG. 3. As can be seen from FIG. 3, the largest strain energy was occurring at the front and rear portions of the bent portion B of the center tube. Accordingly, it is found that if the rigidity of the front and rear portions of the bent portion B is reduced, it is possible to reduce the frequencies of the forward and backward resonance of the exhaust tube.

In the following, the present invention will be explained in accordance with the drawings.

Figure 4:
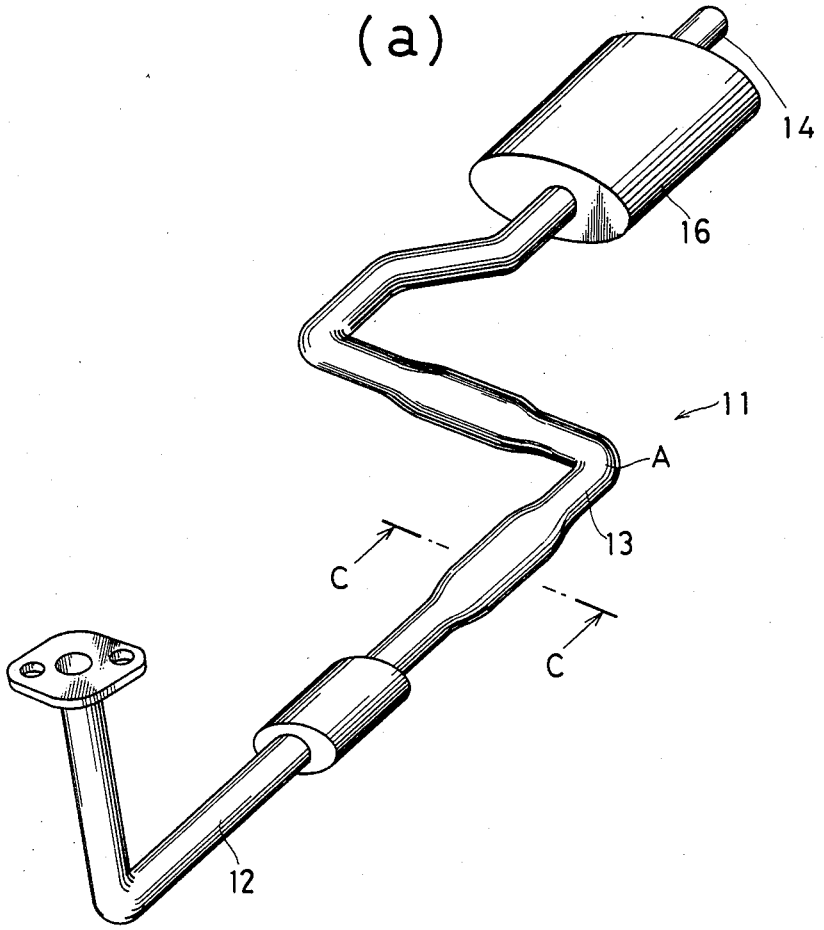
FIG. 4 (*b*) is a cross section taken along line C—C of FIG. 4 (*a*).
Figure 4:
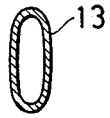

FIG. 3 to FIG. 4 show one of the embodiments of this invention.

In FIG. 4 (*a*), an exhaust tube 11 is comprised of a front tube 12, a center tube 13 and a tail tube 14. Between the front tube 12 and the center tube 13, a pre-muffler 15 is interposed, and between the center tube 13 and the tail tube 14, a muffler 16 is interposed. In the center tube 13, a bent portion A is formed which is bent approximately perpendicularly from the front tube 12 towards the tail tube 14 and which extends in the lateral direction of the vehicle. It is further bent and connected to the main muffler 16. The center tube 13, at the front and rear portions of the bent portion A, is deformed in an oblong shape, respectively, for a length of more than 10 cm, and desirably approximately 25 cm, to an extent which does not hinder the exhaust. Namely, the shape of the cross section, as shown in FIG. 4(*b*), is approximately ovally-shaped with a major axis thereof lying along the vertical direction of the vehicle, which should be compared with the shape being circular before being deformed.

When the respective length of the deformed portions of the center tube 13 is 25 cm, it is possible to reduce the frequencies of the forward and backward resonance from 21 Hz to 19 Hz, or approximately 2 Hz. However, when such length is less than 10 cm, only less than 1 Hz can be reduced. Therefore, it is necessary to deform the center tube more than 10 cm.

Figure 5:
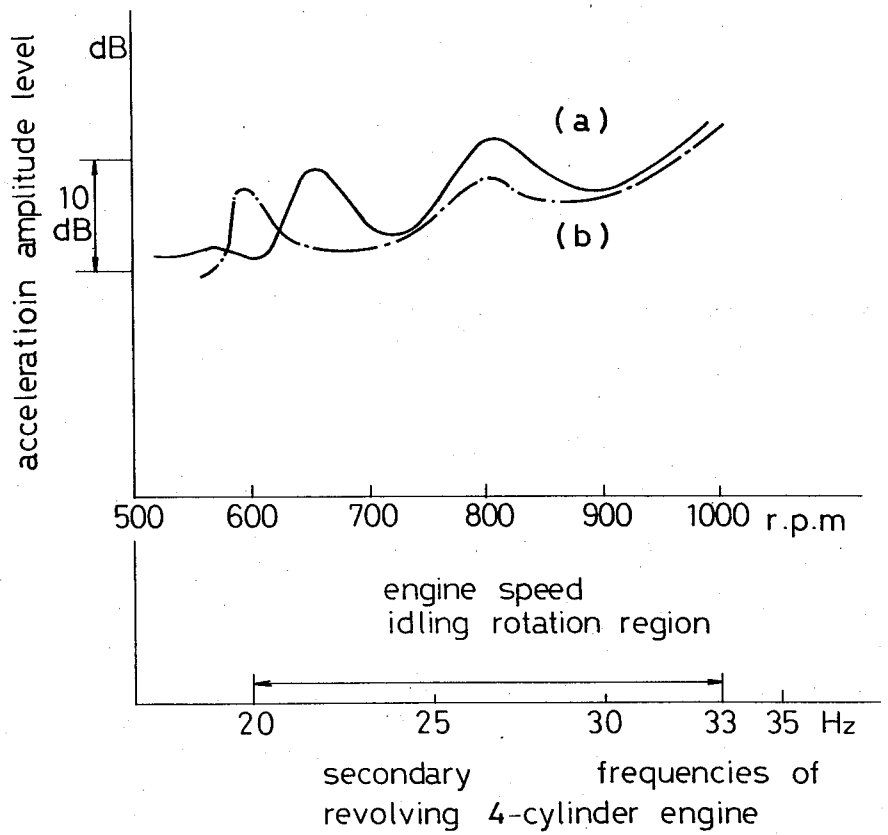
FIG. 5 is a graph which shows the effect of reducing the vertical vibration of the steering wheel when using an exhaust tube according to the present invention

Since the front and rear portions of the bent portion of the circularly sectioned center tube 13 are deformed respectively desirably for a length of approximately 25 cm so as to have an approximately oval shape, the rigidity of the exhaust tube 11 is reduced. As a result, it is possible to reduce the frequencies of the forward and backward resonance of the exhaust tube 11 from 21 Hz to 19 Hz, and hence it is possible to set the frequencies of the forward and backward resonance below the region of the secondary frequencies of the revolving engine (around 20 to 33 Hz) during idling time. Accordingly, as shown in FIG. 5, the exhaust tube for automobile of this invention (shown by dotted line (b) in FIG. 5) can reduce the vertical vibration of the steering wheel in comparison with the prior art exhaust tube for automobile (shown by solid line (a) in FIG. 3). Also in such vehicle as FF vehicle with lateraly disposed engine, there will be no great effect upon the vibration in the rolling direction of the engine, and it will be possible to reduce the floor vibration.

As explained in the above, according to this invention, since the front and rear portions of the bent portion of the center tube are deformed respectively, and thus their sections are made to an oblong shape, it is possible to set the frequencies of the forward and backward resonance of the exhaust tube below the region of the secondary frequencies of the revolving engine during idling time (around 20 to 30 Hz). Accordingly, there will be no great effect upon the vibration in the rolling direction of the engine, and it is possible to reduce the vibrations of the steering wheel and the floor. Also, since flexible tube is not used, reduction in manufacturing cost can be made, and no limitation will be imposed on the layout.

Further, if parts of parking brake, etc. which are placed beneath the floor, are disposed adjacent to the deformed center tube, space can be saved, and the effective usable area of the floor can be increased. Also, the noise inside the room of the vehicle as well as the reduction of vibration during the previously described idling time can be reduced.

What is claimed is:

1. An exhaust tube for a vehicle having a center tube, a front tube and a tail tube, said center tube comprising a bent portion that is bent at approximately right angles from said front tube tube towards said tail tube to extend in the lateral direction of said vehicle, and said bent portion having front and rear portions constructed respectively so that, for a length of more than 10 cm, the cross section thereof is of an oblong-shape with its major axis lying along the vertical direction of the vehicle.

2. The exhaust tube of claim 1, wherein said front and rear portions of said bent portion is made by deforming a circular tube to said oval shape in cross section.

3. The exhaust tube of claim 1, wherein the length of said front and rear portions of said bent portion is approximately 25 cm.

* * * * *